US011273462B2

(12) United States Patent
Young, II

(10) Patent No.: US 11,273,462 B2
(45) Date of Patent: Mar. 15, 2022

(54) SPRAYER SYSTEM

(71) Applicant: Carlisle Fluid Technologies, Inc., Charlotte, NC (US)

(72) Inventor: Roy Earl Young, II, Indianapolis, IN (US)

(73) Assignee: Carlisle Fluid Technologies, Inc., Scottsdale, AZ (US)

( * ) Notice: Subject to any disclaimer, the term of this patent is extended or adjusted under 35 U.S.C. 154(b) by 405 days.

(21) Appl. No.: 15/353,698

(22) Filed: Nov. 16, 2016

(65) Prior Publication Data

US 2017/0151541 A1 Jun. 1, 2017

Related U.S. Application Data

(60) Provisional application No. 62/260,290, filed on Nov. 26, 2015.

(51) Int. Cl.

| | |
|---|---|
| ***B05B 15/25*** | (2018.01) |
| ***B01F 15/00*** | (2006.01) |
| ***B01F 7/16*** | (2006.01) |
| ***B01F 7/18*** | (2006.01) |
| ***B01F 11/00*** | (2006.01) |
| ***B01F 13/10*** | (2006.01) |

(52) U.S. Cl.

CPC ..... *B05B 15/25* (2018.02); *B01F 7/16* (2013.01); *B01F 7/18* (2013.01); *B01F 11/0005* (2013.01); *B01F 13/1022* (2013.01); *B01F 15/00155* (2013.01); *B01F 15/00201* (2013.01); *B01F 15/00259* (2013.01); *B01F 15/00389* (2013.01); *B01F 15/00545* (2013.01); *B01F 2013/1094* (2013.01)

(58) Field of Classification Search

CPC ..... B05B 15/25; B01F 15/00155; B01F 15/00201; B01F 15/00259; B01F 15/00389

USPC ..... 366/142

See application file for complete search history.

(56) References Cited

U.S. PATENT DOCUMENTS

| | | | | |
|---|---|---|---|---|
| 4,722,625 A | | 2/1988 | O'Brien | |
| 5,099,687 A | * | 3/1992 | Lunzer | B67D 7/20 73/198 |
| 5,182,704 A | | 1/1993 | Bengtsson | |

(Continued)

FOREIGN PATENT DOCUMENTS

| | | |
|---|---|---|
| CN | 102380325 A | 3/2012 |
| CN | 102950069 A | 3/2013 |

(Continued)

OTHER PUBLICATIONS

BINKS; "Global Electronic Mix Solutions—Plural Component Mixing System"; Operation Manual; Dated Jul. 2015; 62 pages.

(Continued)

*Primary Examiner* — Marc C Howell

(74) *Attorney, Agent, or Firm* — Fletcher Yoder, P C.

(57) ABSTRACT

A system includes an agitation system having a container configured to store a coating material, an agitator configured to agitate the coating material, and a sensor configured to sense conditions within the container and transmit the conditions. The system also includes an agitation control system having a controller configured to turn on the agitator, and change an intensity of agitation in response to an input received from the agitation system.

20 Claims, 2 Drawing Sheets

(56) References Cited

U.S. PATENT DOCUMENTS

| | | | | |
|---|---|---|---|---|
| 5,636,653 | A | 6/1997 | Titus | |
| 5,656,085 | A | 8/1997 | Hezel | |
| 6,059,884 | A | 5/2000 | Seitz et al. | |
| 6,149,071 | A | 11/2000 | MacCallumMhor et al. | |
| 6,500,262 | B1 | 12/2002 | Bednarz et al. | |
| 6,543,647 | B1 | 4/2003 | Buchholz | |
| 6,628,829 | B1 | 9/2003 | Chasen | |
| 6,896,152 | B2 | 5/2005 | Pittman et al. | |
| 6,935,575 | B2 | 8/2005 | Lacchia et al. | |
| 7,024,285 | B2 | 4/2006 | Saelens | |
| 7,264,160 | B2 | 9/2007 | Polarine et al. | |
| 7,504,338 | B2 | 3/2009 | Du et al. | |
| 7,743,055 | B2 | 6/2010 | Rodrigues et al. | |
| 7,747,615 | B2 | 6/2010 | Rodrigues et al. | |
| 7,792,611 | B2 | 9/2010 | Scheer | |
| 7,822,845 | B2 | 10/2010 | Polarine et al. | |
| 8,109,685 | B1 | 2/2012 | Vito | |
| 8,561,921 | B1 | 10/2013 | Showman et al. | |
| 8,601,977 | B2 | 12/2013 | Mauchle et al. | |
| 2003/0157721 | A1* | 8/2003 | Turner | B01F 15/00201 436/148 |
| 2005/0011967 | A1 | 1/2005 | Skelton-Becker et al. | |
| 2007/0017443 | A1 | 1/2007 | Skelton-Becker et al. | |
| 2007/0032965 | A1 | 2/2007 | McClanahan et al. | |
| 2010/0161141 | A1 | 6/2010 | Herre et al. | |
| 2010/0319176 | A1 | 12/2010 | Stewart et al. | |
| 2011/0004344 | A1* | 1/2011 | Pinton | B01F 7/04 700/265 |
| 2012/0009329 | A1 | 1/2012 | Mather et al. | |
| 2012/0072035 | A1 | 3/2012 | Nielsen et al. | |
| 2012/0109660 | A1 | 5/2012 | Xu et al. | |
| 2012/0254141 | A1 | 10/2012 | Poland et al. | |
| 2012/0321485 | A1 | 12/2012 | Proietti De Marchis | |
| 2013/0083991 | A1 | 4/2013 | Rodrigues et al. | |
| 2013/0128687 | A1* | 5/2013 | Adams | C02F 1/687 366/138 |
| 2013/0242688 | A1* | 9/2013 | Kageler | B01F 7/00233 366/139 |

FOREIGN PATENT DOCUMENTS

| | | | | |
|---|---|---|---|---|
| CN | 103301770 | A | 9/2013 | |
| CN | 104324648 | A | 2/2015 | |
| CN | 204544085 | U | 8/2015 | |
| DE | 102006056879 | A1 | 6/2008 | |
| EP | 0601344 | A1 | 6/1994 | |
| EP | 1298147 | A2 | 4/2003 | |
| EP | 1577599 | A2 | 9/2005 | |
| EP | 1588619 | A2 | 10/2005 | |
| EP | 1776998 | A1 | 4/2007 | |
| EP | 1776998 | A1 * | 4/2007 | B01F 7/00058 |
| EP | 1298147 | B1 * | 11/2017 | |
| JP | H04171068 | A | 6/1992 | |
| JP | 2004330131 | A | 11/2004 | |
| JP | 2013167251 | A | 8/2013 | |
| WO | 9204132 | A1 | 3/1992 | |
| WO | 2011/163579 | A1 | 12/2011 | |
| WO | 2011/163583 | A1 | 12/2011 | |
| WO | 2013098959 | A1 | 7/2013 | |
| WO | WO-2013098959 | A1 * | 7/2013 | B01F 13/045 |
| WO | 2016073499 | A1 | 5/2016 | |

OTHER PUBLICATIONS

BINKS; "Global Mix Solutions—Plural Component Mixing System"; Enhanced Troubleshooting Manual; Dated 2013; 46 pages.
BINKS; "GEMS Global Electronic Mixing Solutions—Beyond Accurate Mixing"; Dated 2015; 4 pages.
BINKS: "GEMS Global Electronic Mixing Solutions—Feeling Pressure to Improve Your Finishing Process?"; Dated 2015; 2 pages.
PCT International Search Report & Written Opinion for PCT Application No. PCT/US2016/062617 dated Mar. 28, 2017, 16 pgs.
Canadian Office Action for CA Application No. 3,006,292 dated Jun. 19, 2019, 3 pgs.
Japanese Office Action for JP Application No. 2018-527215 dated Jul. 30, 2019, 4 pgs.
EP Examination Report for EP Application No. 16805261.1 dated Oct. 22, 2019, 9 pgs.
Chinese Office Action for CN Application No. 201680079605.1 dated Feb. 25, 2020, 11 pgs.
Japanese Office Action for JP Application No. 2018-527215 dated Feb. 18, 2020, 4 pgs.

* cited by examiner

SPRAYER SYSTEM

CROSS-REFERENCE TO RELATED APPLICATION

This application claims priority to and benefit of U.S. Provisional Patent Application No. 62/260,290, entitled "SPRAYER SYSTEM," filed Nov. 26, 2015, which is herein incorporated by reference in its entirety.

BACKGROUND

The present application relates generally to agitators for coating materials.

Spray tools output sprays of coating materials to coat objects for aesthetic or utilitarian purposes. For example, spray tools may be used to paint objects. In operation, the coating material is stored in a container until it is conveyed or pumped to the spray tool. The coating material may include solid particulate components suspended within the liquid coating material which provide a benefit for the coating once applied. Unfortunately, the container may store the coating material long enough (e.g., overnight) that different liquids within the coating material may separate, and/or solid particles may no longer be suspended within the liquid coating material.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment a system includes an agitation system having a container configured to store a coating material, an agitator configured to agitate the coating material, and a sensor configured to sense conditions within the container and transmit the conditions. The system also includes an agitation control system having a controller configured to turn on the agitator, and change an intensity of agitation in response to an input received from the agitation system.

In another embodiment a method includes turning on an agitator at a specific time to agitate a coating material within a container, and changing an agitation intensity of the agitator in response to an input. The input includes operating conditions of the agitator.

In another embodiment a system includes a computer program product being embodied in a non-transitory computer readable storage medium and comprising computer-executable instructions for turning on an agitator at a specific time to agitate a coating material within a container, and changing an agitation intensity of the agitator in response to an input, wherein the input comprises operating conditions of the agitator.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
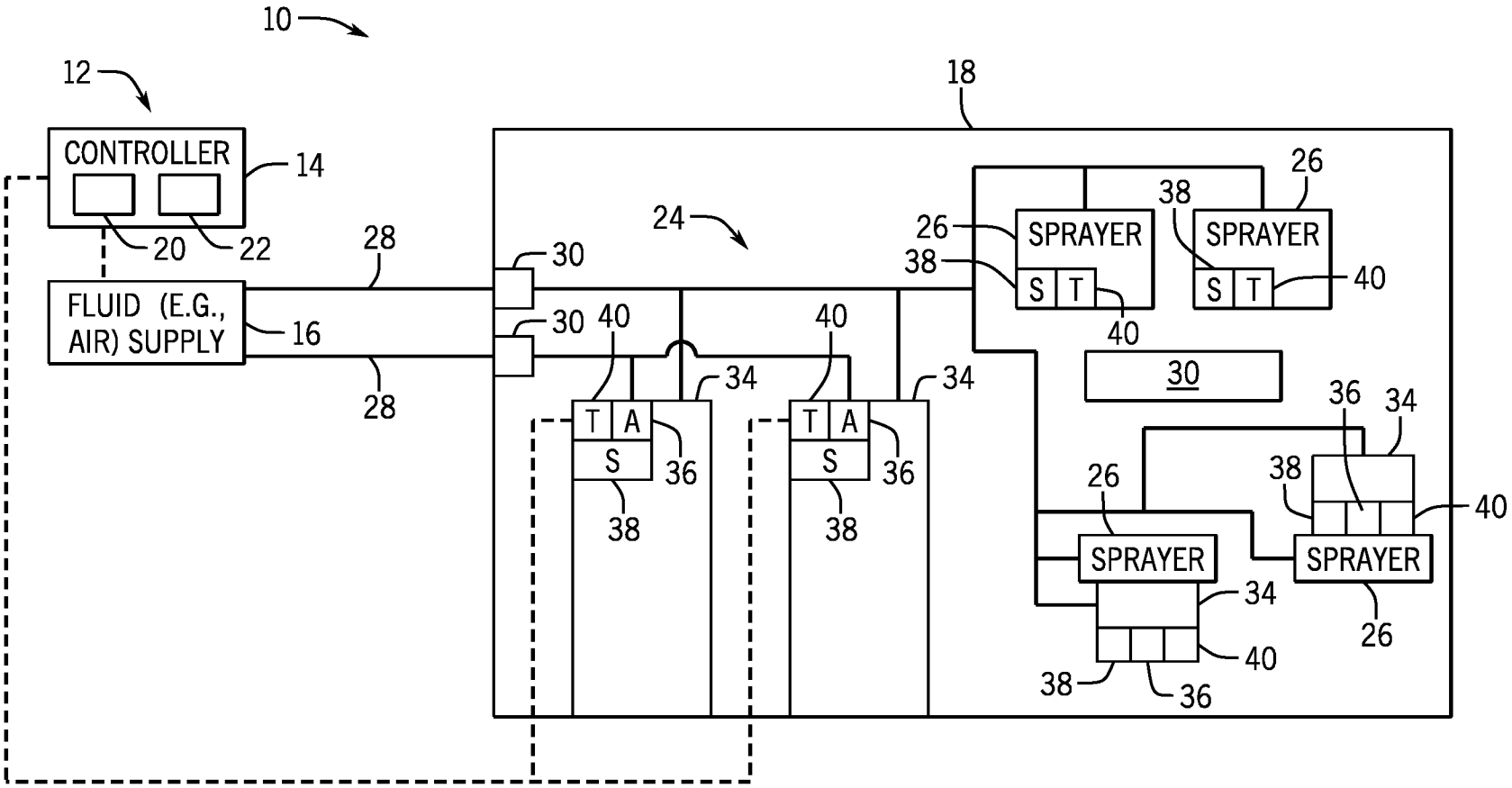
FIG. 1 is a schematic diagram of an embodiment of a spray system with an agitation controller system.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is generally directed to a coating material agitation system capable of controlling agitation of a coating material stored within a container. More specifically, the disclosure is directed towards a controller that adjusts the agitation of a coating material (e.g., paint or other coating fluid) to minimize power usage and over-mixing of the coating material. As will be discussed in more detail below, the controller adjusts an agitator (e.g., a mechanical mixer driven by an electric or fluid-driven motor) in response to user input and/or sensor input to provide a suitable intensity of agitation to achieve desired properties of the fluid mixture, an applied spray coating, or other parameters. For example, the controller may increase an intensity of the agitator (e.g., speed of rotation of mixer, intensity of vibration, etc.) if user input and/or sensor feedback indicates non-uniform mixing of the coating fluid, non-uniformity in the spray coating applied to a target object, high resistance to mixing, high viscosity, or other feedback indicating a need for greater mixing. By further example, the controller may decrease an intensity of the agitator (e.g., speed of rotation of mixer, intensity of vibration, etc.) if user input and/or sensor feedback indicates substantially uniform mixing of the coating fluid, substantial uniformity in the spray coating applied to a target object, low resistance to mixing, low viscosity, or other feedback indicating that less mixing is necessary. In this manner, by increasing the intensity of agitation when needed and reducing the intensity of agitation when not needed, the controller helps to reduce energy consumption and wear by the agitator and associated equipment, while also ensuring that properties of the coating fluid are within acceptable thresholds (e.g., sufficiently uniform color, viscosity, etc.). As further discussed below, the disclosed embodiments may position various electrical equipment (e.g., control system, motors, pumps, compressors, etc.) outside of a containment room (e.g., for spraying various objects), while enabling wired or wireless communications for control of the electrical equipment.

FIG. 1 is a schematic diagram of an embodiment of a spray system 10 that utilizes an agitation controller system 12 (or control system). The agitation control system may include a controller 14 (e.g., electronic controller) and a fluid supply 16 (e.g., gas or liquid supply) positioned externally to a containment room 18 (e.g., paint kitchen). For example, the fluid supply 16 may be a gas supply 16, such as an air supply, an inert gas supply (e.g., nitrogen), or a combination thereof. For example, the fluid supply 16 may include a motor-driven compressor, a motor-driven fan or blower, a motor driven pump, a storage tank, actuator-driven flow controls (e.g., actuator-driven valves, actuator-driven pressure regulators, and/or actuator-driven flow regulators), or any combination thereof. In certain embodiments, the motors used for the motor-driven pumps and compressors may be electric motors, and the actuators used for the flow controls may be electric actuators. All of these electric devices (e.g., motors, actuators, and electronics of the controller 14) may be disposed outside of the containment room 18 to electrically isolate the interior of the containment room 18. The containment room 18 may be sealed to inhibit paint droplets or other coating material fumes from spreading to unwanted areas. Also, the containment room 18 may be insulated from electrical or other influences to block contaminants from entering the containment room 18. In some instances, the containment room 18 may be used to spray or apply coating material that is regulated or potentially flammable. Under such circumstances, the components and devices used in the containment room 18 may be constructed to provide additional protection against ignition of the coating material. As such, it may be desirable to locate electronic components external to the containment room 18. For example, the controller 14 may be located external to the containment room 18 as it may include electrical components such as a processor 20 and a memory 22. Likewise, the fluid supply 16 may be located external to the containment room 18, because the fluid supply 16 may include electric motors, actuators, or other electronics associated with supplying the fluid (e.g., gas or liquid) to the components inside of the containment room 18.

In operation, the processor 20 may receive and distribute signals between various locations within the spray system 10. The memory 22 may store a computer program embodied in a non-transitory computer readable storage medium having computer-executable instructions for performing the various functions of the controller 14. The instructions may involve feedback from one or more sensors or user inputs within and/or outside the containment room 18, as explained in detail below.

The controller 14 may be in electronic communication (e.g., wired or wireless communications) with an agitation system 24, one or more sprayers 26 (e.g., spray guns), or other devices within the containment room 18. For example, the controller 14 may communicate wirelessly over one or more wireless channels, frequencies, etc. and/or via one or more wired communication lines. In certain embodiments, each sprayer 26 may communicate with the controller 14 and/or the agitation system 24 via a different communications channel (e.g., wireless frequency, wired line, etc.) and/or a common communications channel. Likewise, each component of the agitation system 24 (e.g., mixing containers 34) may communicate with the controller 14 and/or the sprayers 26 via a different communications channel (e.g., wireless frequency, wired line, etc.) and/or a common communications channel. The communications over these channels may include sensor feedback, user input, control signals, or any combination thereof. For example, the user input and/or sensor feedback may be communicated to the controller 14 from the sprayers 26 and/or the agitation system 24, which may trigger the controller 14 to adjust the fluid supply 16 (e.g., motor speed, valve position, pressure, flow rate, etc.) and/or other parameters affecting the fluid mixing, spray quality from the sprayers 26, or any other operational parameters.

The sprayer 26 may include a spray head, a body coupled to the spray head, a handle coupled to the body, and a trigger configured to control operation/flow of spray. The spray head may include atomization orifices, spray shaping orifices, a bell cup, a rotary head, an electrostatic device, or a combination thereof. The sprayer 26 may also include a valve to control flow of the coating material and a valve to control flow of a gas (e.g., air) used to atomize and/or shape the spray. The sprayers 26 may include gravity feed spray guns, siphon-feed spray guns, pneumatic atomization spray guns, hydraulic atomization spray guns, rotary spray guns, electrostatic spray guns, or any combination thereof.

The agitation system 24 may include an electronic motor, in which case the controller 14 may directly control the intensity and/or timing of the motor. In certain embodiments, the intensity may be a speed of rotation of a rotor (e.g., with various impellers, blades, protrusions, etc.), a vibration frequency or amplitude of a storage container (e.g., a vibration device driven by an electric motor or fluid-driven motor), or other quantification of agitation. Also, the agitation system 24 may include a fluid-driven (e.g., pneumatic motor or hydraulic motor) in which case, the controller 14 may indirectly control the agitation system 24 by controlling the fluid supply 16 (e.g., air supply), which delivers a specified amount of air 28 to the agitation system 24. Although any fluid may be used with the agitation system 24, the following discussion refers to air as an example. The fluid supply 16 may supply air 28 to the sprayer(s) 26 for atomizing or shaping the spray of the coating material onto an object 30. In conveying the air 28, the agitation control system 12 may include a volume booster 32 installed within the containment room 18 to increase the amount of air 28 flowing from the fluid supply 16. In certain embodiments, the volume booster 32 increases the amount of air 28 in direct proportion to the amount that the controller 14 communicates to the fluid supply 16. Thus, the controller 14 is able to control to a substantially high degree the amount of air that is delivered to the agitation system 24.

The agitation system 24 may include one or more containers 34 that contain a coating material that is used to coat the object 30. FIG. 1 illustrates four containers 34, but the controller 14 may be used to control agitation within 1, 3, 4, 5, 6, 7, 8, 9, 10, or more containers 34 that hold coating material for use by 1, 2, 3, 4, 5, 6, 7, 8, 9, 10, or more sprayers 26. For example, the containers 34 may include remote containers coupled to sprayers 26 via conduits, gravity feed containers mounted to tops of the sprayer 26, siphon feed containers mounted to bottoms of the sprayers 26, or any combination thereof. The containers 34 house agitators 36 that stir up the coating material to make sure that a uniform consistency of the coating material is delivered to the sprayers 26. As mentioned above, the coating material may include liquids or solids that may separate from one another. The solids can settle to the bottom of the container 34 which causes the finish of the coating material to be inconsistent. The agitator 36 may be a fluid-driven agitator (e.g., pneumatic agitator) that is powered by the air 28 that is delivered from the fluid supply 16. In certain embodiments, the agitator 36 may include an electric motor that has been developed to safely agitate the coating material within the containment room 18. The agitation system 24 also includes a sensor or sensors 38 for each agitator 36, container 34, and/or sprayers 26, wherein the sensors 38 sense operating conditions of the agitator 36, container 34, and/or sprayers 26. For example, the sensor 38 may detect a revolution speed (e.g., revolutions per minute (rpm)) of the agitator 36, an amount of coating material within the container 34, the degree to which the coating material is homogenized, viscosity of the coating material, color or color uniformity of the coating material, environmental conditions (e.g., temperature, humidity) within or outside the container 34, finish quality (e.g., consistency, color, uniformity, droplet size, etc.) of the coating material sprayed onto the target object 30, characteristics of the coating material flowing through the sprayer 26, or any combination of these or other parameters.

As illustrated, the sensor 38 may be coupled to a transmitter 40 that transmits the operating conditions detected by the sensor 38 to the controller 14. The controller 14 is then able to adjust or control the air 28 from the fluid supply 16. In this way, the agitation control system 12 can control the speed (e.g., rpm) of the agitator 36 as a closed-loop without an operator being forced to interface with the agitator 36 throughout a work period. In other words, if an operator is using the sprayer 26 inside the containment room 18, then the operator can control the fluid supply 16 and thus the mixing by the agitator 36 without leaving the containment room 18 to interface with the agitator controller system 12. In particular, the control of the fluid supply 16 by the agitator controller system 12 may occur automatically in response to sensor feedback from the sensors 38, in response to user input at the sprayers 26 and/or the containers 34, or any combination thereof. Furthermore, the agitator controller system 12 may maintain the quality of mixing by the agitation system 24 within certain thresholds, such as upper and lower thresholds of acceptable color, viscosity, temperature, or any combination thereof, thereby enabling the operator to continue spraying operations with the sprayer 26 without any significant downtime for making adjustments. For example, the operator and/or the sprayer 26 may remain at the location of the object 30 while adjustments are being implemented by the agitator controller system 12 via wired or wireless communications between the interior and exterior of the containment room 18. In certain embodiments, the agitator controller system 12 may increase an intensity of the agitation system 24 (e.g., increase speed of agitator 36) if sensor feedback indicates poor mixing, high viscosity or high resistance to mixing, non-uniform color distribution, or any combination, while the agitator controller system 12 may decrease an intensity of the agitation system 24 (e.g., decrease speed of agitator 36) if sensor feedback indicates acceptable mixing, low viscosity or low resistance to mixing, uniform color distribution, or any combination.

The sensors 38 and the transmitter 40 may be embodied as one article that senses and transmits the operating conditions. Additionally, the sensors 38 may be placed within the container 34 to detect fluid levels, saturation of air within the coating material, temperature of the coating material, viscosity of the coating material, color or color uniformity of the coating material, and so forth. The sensors 38 may also be located outside of the container 34 to detect environmental conditions within the containment room 18. In particular, the sensors 38 may detect a rotation speed for the agitator 34. For example, the sensors 38 may include a camera focused on a portion of the agitator 36 to detect the speed. The agitator 36 may include a stripe or set of stripes that the sensor 38 uses to determine the rpm of the agitator 36. The sensor 38 and transmitter 40 may also include fiber optic cable that detects a light emitted by a light source on the agitator, and is thus able to determine the rpm of the agitator 36.

The transmitters 40 may be paired to channels (e.g., frequencies) within the controller 14 that allow agitators 36 to be moved and/or replaced. That is, settings for a particular container 14, agitator 36, sensor 38, or any combination thereof may be saved on the controller 14 to enable quick replacement and setup when one or more components of the agitation system 24 or the agitation control system 12 is changed.

Figure 2:
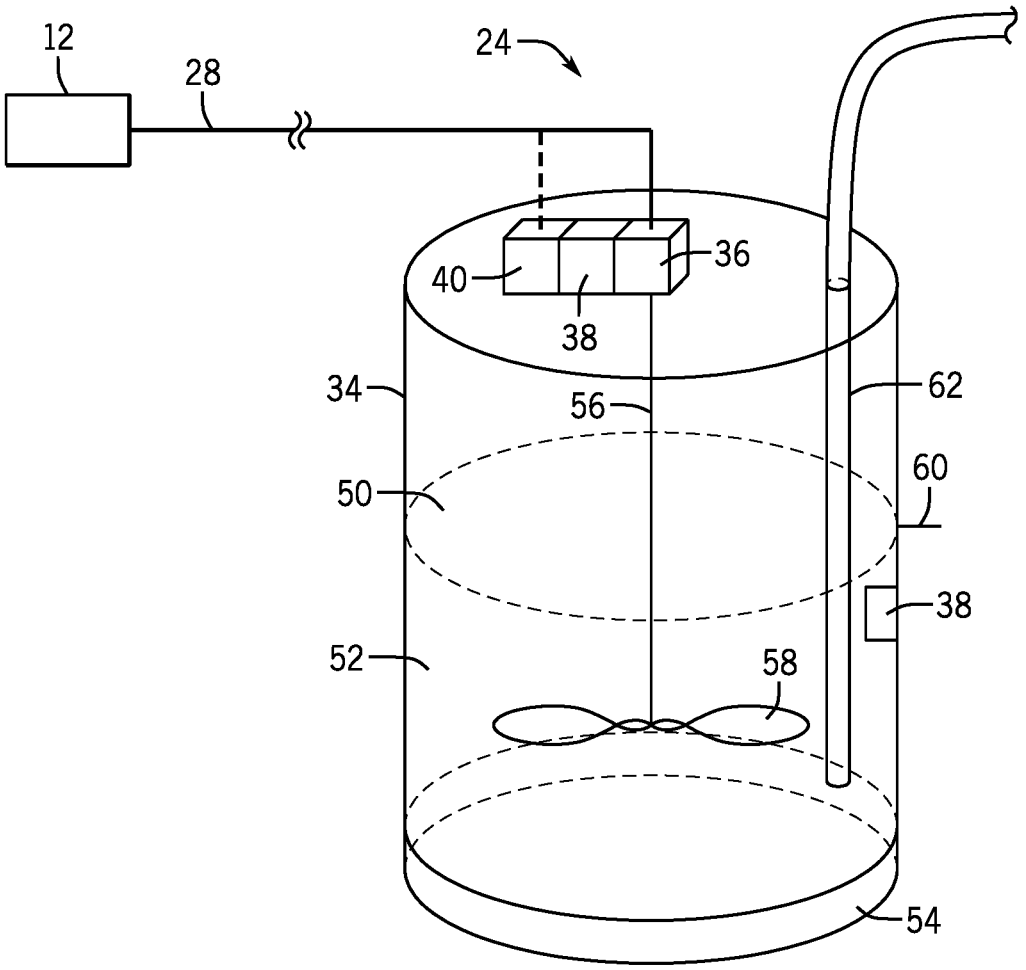
FIG. 2 is a perspective view of an embodiment of a coating material container and an agitation controller system.

FIG. 2 is a perspective view of an embodiment of the agitation control system 12 and the agitation system 24 shown in FIG. 1. The agitation control system 12 may include the controller 14 and the fluid supply 16 as explained above to control the agitation system 24 based on the detected operating conditions. The container 34 of the agitation system 24 may include a coating material 50 that may be separated into multiple constituent components. For example, the coating material 50 may include a first component 52 and a second component 54. The second component 54, for example, may include solids that drop to the bottom of the container 34 when the coating material 50 is still (e.g., not agitated) for a certain amount of time. To mix the second component 54, the agitator 36 may include a rod 56 and a blade 58 (e.g., a plurality of radial protrusions, blades, or impellors) that rotate when the agitator 36 rotates. Any reasonable rod 56 or blade 58 combination may be used to agitate the coating material 50 and certain embodiments may include additional rods 56 and/or additional blades 58. For example, some coating materials 50 may be more or less viscous than other coating materials 50, which may cause one style of agitator 36 to work better than another.

The viscosity of the coating material 50 may also mean that different amounts of air 28 will produce a different speed (e.g., rpm) for a given agitator 36. For example, a less viscous coating material 50 may enable the agitator 36 to rotate faster with less air 28 delivered to the agitator 36. The speed (e.g., rpm) of the agitator 36 may also depend upon a level 60 of remaining coating material 50 within the container 34. As the coating material 50 is drawn through a hose 62 toward the sprayer 26, the level 60 of the coating material 50 drops, and the resistance to rotation of the rod 56 and the blade 58 drops. Thus, it is useful for the controller 14 to accurately determine and/or control the speed (e.g., rpm) of the agitator 36 through the entire range of the level 60.

Figure 3:
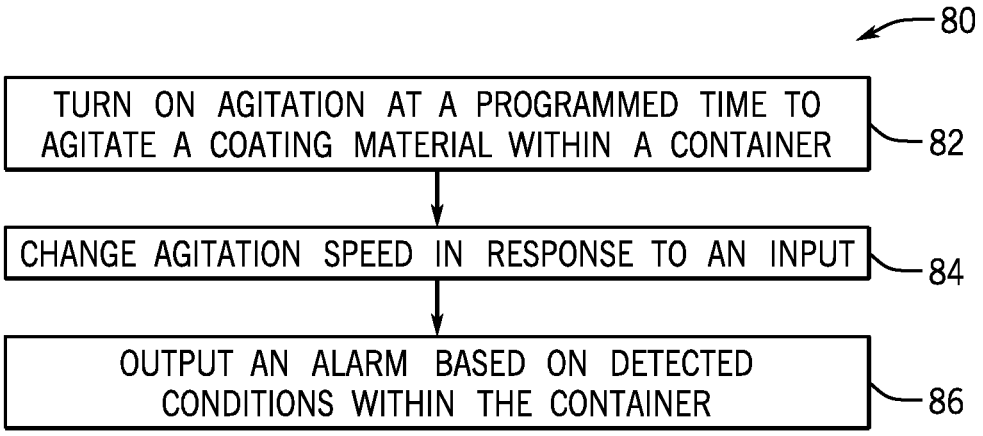
FIG. 3 is a flow chart of an embodiment of a method for controlling the spray system shown in FIG. 1.

FIG. 3 is a flow chart of an embodiment of a computer-implemented method 80 for controlling the agitation control system 12 shown in FIGS. 1 and 2. The controller 14, for example, may perform the method 80. The method 80 begins when the agitation control system 12 is turned on and begins to agitate the coating material 50 within the container 34 (block 82). The agitation control system 12 may be turned on at a programmed time to enable the coating material 50 to be mixed before an operator begins spraying operations. Depending on the composition of the coating material 50, the agitation may begin at a time period before spraying. The time period that agitation begins before spraying may be about one or more seconds, one to two minutes, or one or more hours, and all subranges therebetween. Mixing the coating material 50 may produce a more uniformly mixed coating material 50. That is, if the coating material 50 is easy to mix (e.g., few solids that are easily distributed), then the agitation control system 12 may start and begin to agitate the coating material 50 for a short time before spraying begins. On the other hand, if the coating material 50 is hard to mix (e.g., high concentrations of solids that have a high likelihood of settling), the agitation control system 12 may start and begin to agitate the coating material 50 for a longer period of time before spraying begins. For example, the control system 12 may perform an agitation procedure prior to allowing a spraying procedure to begin. In some embodiments, the agitation procedure may be triggered by a switch or trigger on the sprayers 26, and the switch or trigger may be the same or different from a switch or trigger used to initiate spraying with the sprayer 26. Upon completion of the agitation procedure (e.g., predetermined time or sensor feedback indicating ready), the control system 12 may enable the spraying procedure.

The method 80 also includes changing the agitation intensity in response to an input (block 84). The agitation intensity of the agitator 36 may depend upon many factors such as the composition of the coating material 50, the level 60, environmental conditions within or outside the container 34, viscosity of the coating material, color or color uniformity of the coating material, and flow rate to the sprayer 26 (e.g., amount of coating material 50 leaving the container 34), among others. The sensor 38 detects these conditions and the transmitter 40 transmits a signal back to the controller 14 which adjusts the intensity of the agitator 36, the container 34, or the sprayer 26. The intensity of the agitator 36 may be controlled, for example, by adjusting the amount of air delivered by the fluid supply 16. In this manner, the agitation control system 12 and the agitation system 24 may control the intensity of agitation in a closed-loop manner without interaction from an operator. Changing the agitation intensity may also include lowering the intensity after a given period of time has elapsed for agitating the coating material 50. That is, once the solids 54 have been mixed into the coating material 50, the intensity of agitation may be lowered to merely maintain the uniformity of the coating material 50.

The method 80 also may include outputting an alarm based on the detected conditions within the container 34. Conditions may include a drop in the level 60 below a certain limit, a difference between the detected speed (e.g., rpm) of the agitator 36 and the expected speed (e.g., rpm), and a time period of agitation that is longer than a specified duration. The alarms may include merely storing the information on the memory 22, or sending a signal to an operator, or the controller 14 may be programmed to stop agitating automatically when certain conditions are detected by the sensor 38.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a sprayer located within a containment room;

an agitation system located within the containment room, comprising:

a container configured to store a coating material;

a first agitator configured to agitate the coating material; and a sensor configured to sense conditions within the container, wherein the sensor is coupled to a wall of the container such that the sensor is positioned fully within an inner volume of the container, and wherein the sensor is configured to determine an operating condition of the first agitator; and an agitation control system located outside of the containment room and coupled to the agitation system, comprising:

a controller configured to change an intensity of the first agitator in response to an input from the sensor.

2. The system of claim 1, wherein the first agitator comprises a fluid-driven agitator having one or more stripes, wherein the agitation control system comprises a fluid supply configured to deliver a fluid to drive the first agitator, and wherein the sensor is configured to detect the one or more stripes.

3. The system of claim 1, wherein the controller is configured to operate the first agitator to agitate the coating material with an increase in the intensity if one or more parameters are not within one or more thresholds thereby indicating non-uniformity associated with the coating material, and the controller is configured to operate the first agitator to agitate the coating material with a decrease in the intensity if the one or more parameters are within the one or more thresholds thereby indicating uniformity associated with the coating material.

4. The system of claim 1, wherein the operating condition is a speed of the first agitator, and wherein the agitation control system is configured to begin agitation at a programmed time before spraying operations.

5. The system of claim 4, wherein the sensor comprises a fiber optic cable configured to detect pulses of light to measure the speed of the first agitator.

6. The system of claim 1, comprising:

a second agitation system, comprising:

a second container configured to store a second coating material;

a second agitator configured to agitate the second coating material; and a second sensor configured to sense conditions within the second container, wherein the controller is configured to control the second agitator.

7. The system of claim 6, wherein the first agitator and the second agitator are paired to the controller with separate wireless communication channels.

8. A method, comprising:

activating, with a controller disposed external to a containment room, a first agitator at a first time and at a first agitation intensity, wherein the first agitator is disposed within the containment room and agitates a coating material within a container;

changing, with the controller, the first agitation intensity of the first agitator in response to an input received from a sensor; and spraying a spray coating within the containment room.

9. The method of claim 8, wherein the first agitator comprises a fluid-driven agitator having one or more stripes, wherein activating the first agitator comprises sending a signal to a fluid supply to deliver fluid to the first agitator, and wherein the input comprises a speed of the first agitator determined by the sensor via detection of the one or more stripes.

10. The method of claim 8, wherein the sensor is configured to detect a level of the coating material within the container, wherein changing the first agitation intensity comprises changing the first agitation intensity in response to a change in the level of the coating material.

11. The method of claim 8, wherein the input comprises a signal from the sensor configured to detect revolutions per minute (rpm) of the first agitator, comprising identifying a difference between the detected rpm and an expected rpm caused by varying resistance to rotation of the first agitator, and controlling the rpm of the first agitator based on the difference.

12. The method of claim 8, wherein the sensor is mounted directly to a wall of the container and is positioned completely within an inner volume of the container.

13. The method of claim 8, wherein the input comprises operating conditions of the first agitator, and the operating conditions comprise a difference between a detected agitation intensity of the first agitator and an expected agitation intensity of the first agitator, or a time period of agitation that is longer than a specified duration.

14. The method of claim 8, comprising activating, with the controller, a second agitator at a second time and at a second agitation intensity, wherein the second agitator agitates a second coating material within a second container.

15. The method of claim 14, comprising receiving, with the controller, the first time and the first agitation intensity via a first wireless communication channel; and receiving, with the controller, the second time and the second agitation intensity via a second wireless communication channel, wherein the controller is configured to operate the first agitator at the first time and at the first agitation intensity in response to detecting the first wireless communication channel and to operate the second agitator at the second time and at the second agitation intensity in response to detecting the second wireless communication channel.

16. A system, comprising:

an agitation system configured to be located within a containment room, wherein the agitation system, comprises:

a container configured to store a coating material for a sprayer;

an agitator configured to agitate the coating material; and a sensor configured to sense one or more parameters associated with the coating material; and an agitation control system configured to be located outside of the containment room, comprising:

a controller configured to change an intensity of the agitator in response to an input from the sensor, wherein the agitation control system is communicatively coupled to the agitation system, wherein the controller is configured to operate the first agitator to agitate the coating material with an increase in the intensity if the one or more parameters are not within one or more thresholds thereby indicating non-uniformity associated with the coating material, and the controller is configured to operate the first agitator to agitate the coating material with a decrease in the intensity if the one or more parameters are within the one or more thresholds thereby indicating uniformity associated with the coating material.

17. The system of claim 16, wherein the sensor is attached to a wall of the container such that the sensor is positioned entirely within an inner volume of the container, wherein the sensor is configured to sense conditions within the container, and wherein the sensor is configured to determine a speed of the agitator.

18. The system of claim 16, wherein one of a group of the container, the agitator, and the sensor of the agitation system is configured to communicate with the agitation control system via a first wireless communication channel, and a remaining two of the group of the container, the agitator, and the sensor of the agitation system are configured to communicate with the agitation control system via a second communication channel.

19. The system of claim 18, wherein the second communication channel is a second wireless communication channel.

20. The system of claim 16, wherein the one or more parameters relate to a uniformity in mixing of the coating material or a uniformity in a spray coating of the coating material.

* * * * *